US011198156B2

(12) United States Patent
Murphy

(10) Patent No.: US 11,198,156 B2
(45) Date of Patent: Dec. 14, 2021

(54) SCREENING BAR ASSEMBLY FOR A SCREEN

(71) Applicant: Terex GB Limited, Dungannon (GB)

(72) Inventor: Glenn Murphy, Craigavon (GB)

( * ) Notice: Subject to any disclaimer, the term of this patent is extended or adjusted under 35 U.S.C. 154(b) by 181 days.

(21) Appl. No.: 16/252,913

(22) Filed: Jan. 21, 2019

(65) Prior Publication Data

US 2019/0224719 A1 Jul. 25, 2019

(30) Foreign Application Priority Data

Jan. 23, 2018 (GB) ..... 1801107

(51) Int. Cl.
*B07B 1/12* (2006.01)
*B07B 1/46* (2006.01)
*B07B 1/28* (2006.01)

(52) U.S. Cl.
CPC ..... *B07B 1/12* (2013.01); *B07B 1/28* (2013.01); *B07B 1/4645* (2013.01)

(58) Field of Classification Search
CPC ..... B07B 1/12; B07B 1/28; B07B 1/4645
USPC ..... 209/395
See application file for complete search history.

(56) References Cited

U.S. PATENT DOCUMENTS 2,790,552 A * 4/1957 Symons ..... B07B 1/46 209/395
4,381,235 A 4/1983 Mallaghan
5,560,496 A * 10/1996 Lynn ..... B07B 1/12 209/395
5,816,412 A * 10/1998 Bokor ..... B07B 1/4645 209/326
5,901,857 A * 5/1999 Schurman ..... B07B 1/12 209/674
7,216,768 B2 * 5/2007 Fisher ..... B01D 33/0376 209/395
8,403,147 B2 3/2013 Sauser et al.
8,820,536 B2 9/2014 Schirm
8,875,900 B2 11/2014 Sauser
8,915,375 B2 12/2014 Sauser et al.
8,915,376 B2 12/2014 Garland
8,979,008 B2 3/2015 Sauser et al.
9,010,543 B2 4/2015 Schirm et al.
9,205,459 B2 12/2015 Sauser
9,238,255 B2 1/2016 Sauser et al.
9,296,017 B2 3/2016 Robinson
(Continued)

FOREIGN PATENT DOCUMENTS

DE 1036782 B 8/1958
EP 0945189 A2 9/1999
(Continued)

OTHER PUBLICATIONS

European Search Report, dated Aug. 6, 2019, for EP patent application 19151291, a foreign counterpart application.

*Primary Examiner* — Charles A Fox
*Assistant Examiner* — Molly K Devine
(74) *Attorney, Agent, or Firm* — Warner Norcross + Judd LLP

(57) ABSTRACT

A screening bar assembly for a screen, the assembly comprising a plurality of substantially parallel screening bars mounted to a substantially rectangular support frame; a compliant mounting block being provided at each end of each screening bar to engage the support frame and a screen incorporating said assembly.

21 Claims, 4 Drawing Sheets

(56) References Cited

U.S. PATENT DOCUMENTS

| | | | |
|---|---|---|---|
| 9,427,745 | B2 | 8/2016 | Dunn et al. |
| 9,611,099 | B2 | 4/2017 | Watters |
| 9,849,461 | B2 | 12/2017 | Sauser et al. |
| 9,895,696 | B2 | 2/2018 | Hamilton et al. |
| 10,086,407 | B2 | 10/2018 | Sauser |
| 10,179,348 | B2 | 1/2019 | Schirm et al. |

FOREIGN PATENT DOCUMENTS

| | | | |
|---|---|---|---|
| EP | 1726370 | A2 | 11/2006 |
| FR | 1340492 | A | 10/1963 |
| FR | 2515074 | A1 | 4/1983 |
| FR | 2545385 | A1 | 11/1984 |

* cited by examiner

SCREENING BAR ASSEMBLY FOR A SCREEN

FIELD OF THE INVENTION

This invention relates to a screening bar assembly for a screen for grading particulate material and in particular to a bofor bar assembly for a screen of the type typically referred to as a "grizzly" screen and to a screen incorporating said assembly.

BACKGROUND OF THE INVENTION

Grizzly screens are typically used to separate larger rocks and boulders from quarried or mined material prior to further grading/treatment of the material. A grizzly screen typically comprises one or more sets of parallel metal bars, often called "bofor bars", mounted to define a sloping deck onto which the feed material is adapted to be delivered. The bars are normally mounted parallel to the slope of the deck and the path of the material thereon. The length of each bar may be up to 3 m and the spacing between the bars ranges from 50 to 200 mm typically, although wider spacing is possible. The present invention is also applicable to Rip Rap screen media and static grids used to protect machinery and separate out large piece sizes from fines material (e.g. Gabion stone etc.).

A coarse feed (say from a primary crusher) may be fed at the upper end of the deck of the screen. Larger chunks roll and slide to the lower discharge end, while smaller lumps having sizes less than the gaps between the bars fall into a collection hopper, conveyor or further deck therebeneath.

Often the screen is mounted on a chassis or base via compliant linkages, such as springs, and the screen may be vibrated by a vibration generating means, such as one or more rotors defining eccentric masses, driven by one or more drive motors, to impart circular or reciprocating vibratory motion to the deck.

Conventionally the bars of such screens are welded or bolted to a support frame in which they are mounted. Such rigid connections between the bars and support frame tend to fracture under the heavy loads as rocks impact on the bars. An object of the present invention is to provide improved screen with a more reliable coupling between the bars of the screen and their support frame.

SUMMARY OF THE INVENTION

According to a first aspect of the present invention there is provided a screening bar assembly for a screen, the assembly comprising a plurality of substantially parallel screening bars mounted to a substantially rectangular support frame; a compliant mounting block being provided at each end of each bofor bar to engage the support frame. The mounting blocks may be formed from a polymeric material, a metallic spring material, a suitable non-metallic material or a fibrous or composite material. The mounting blocks are made from a different material from the bars, such material having sufficient compliance and elasticity to absorb shocks due to the impact of rocks and boulders with the bars and to resist transmission of such shocks to the support frame.

In one embodiment said support frame may include a pair of opposing mounting channels arranged, said mounting blocks engaging said mounting channels to couple the screening bars to the support frame. The support frame may comprise a pair of substantially parallel side members and a pair of end members extending between and perpendicular to the side members, said end members of the support frame incorporating said mounting channels. Preferably the screening bars, when mounted on the support frame, extend parallel to the side members of the support frame. Each side member of the support frame may include a laterally extending mounting flange to facilitate mounting of the support frame to the screen. Alternatively, or additionally, mounting flanges may be provided on the end members of the support frame.

In one embodiment each end of each screening bar may incorporate a mounting recess within which a portion of a respective mounting block is received. Preferably the sides of each mounting recess diverge outwardly from one another to define a wedge shaped recess receiving a correspondingly shaped portion of the respective mounting block.

In one embodiment the vertical depth of each screening bar may increase from one end to the other. An end of each screening bar at its deepest portion may extend above the support frame. Preferably the vertical depth of each screening bar increases from an upstream to a down stream end when installed in the support frame and mounted on the screen, in use.

Spacer members may be inserted between the mounting blocks of adjacent bars to maintain the position of the bars in the support frame. Preferably said spacer members are located within said mounting channels of the support frame.

Retaining members may be releasably attached to the support frame, the retaining members having fingers shaped to extend between the ends of adjacent bars to retain the spacer members in position.

According to a further aspect of the present invention there is provided a screen comprising a frame defined by a pair of substantially parallel side walls interconnected by transversely extending bridging members, one of more screening bar assemblies in accordance with the first aspect of the invention being mounted on the frame to define a sloping deck, the bars of each screening bar assembly being aligned with the slope of the deck and the path of the material thereon.

The screen may include means for imparting circular or reciprocating vibratory motion to the deck.

BRIEF DESCRIPTION OF THE DRAWINGS

A screen incorporating a screening bar assembly in accordance with an embodiment of the present invention will now be described, by way of example only, with reference to the accompanying drawings, in which.

DETAILED DESCRIPTION OF THE DRAWINGS

Figure 1:
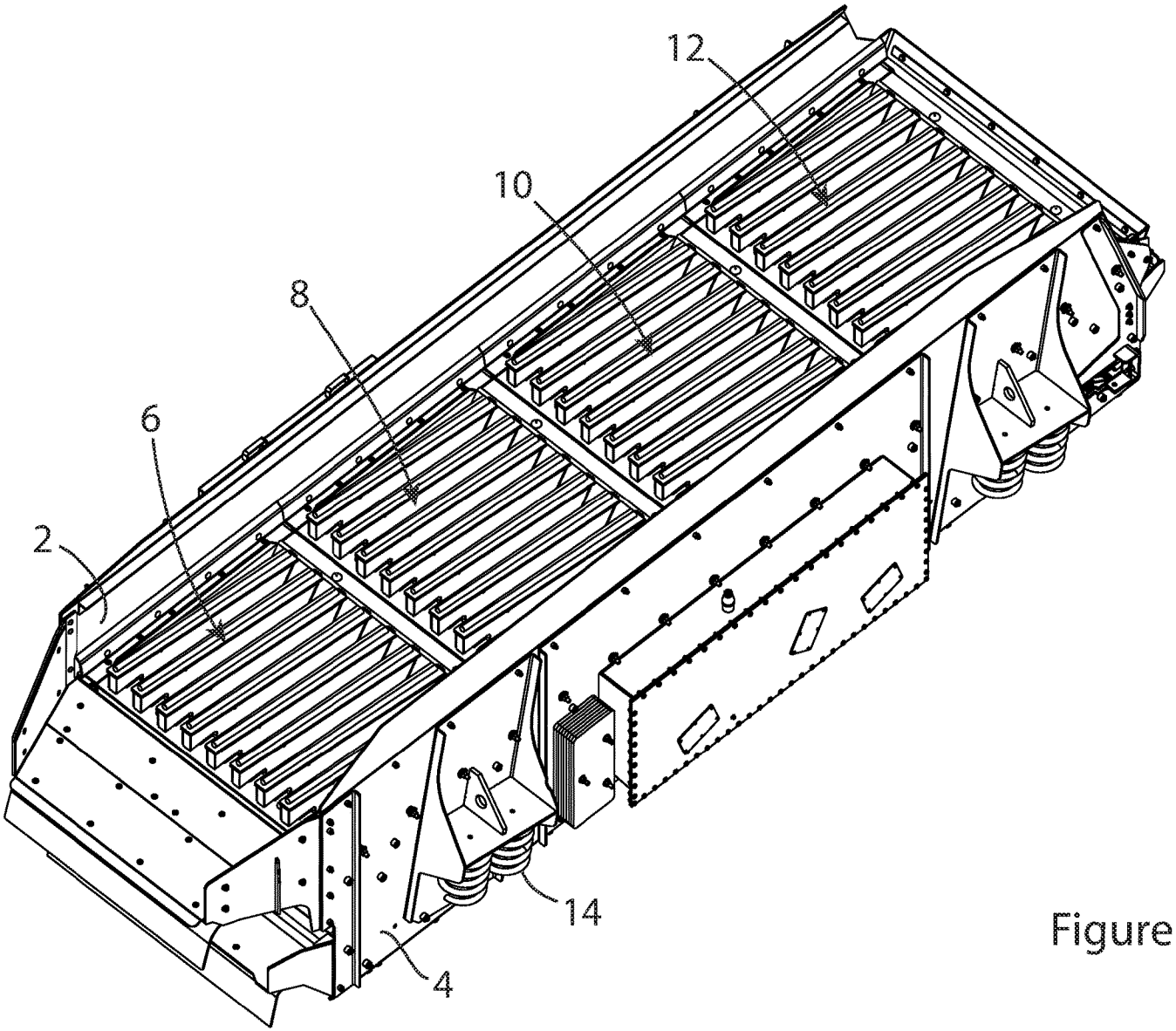
FIG. 1 is a perspective view of a grizzly screen incorporating a screening bar assembly in accordance with an embodiment of the present invention.
Figure 2:
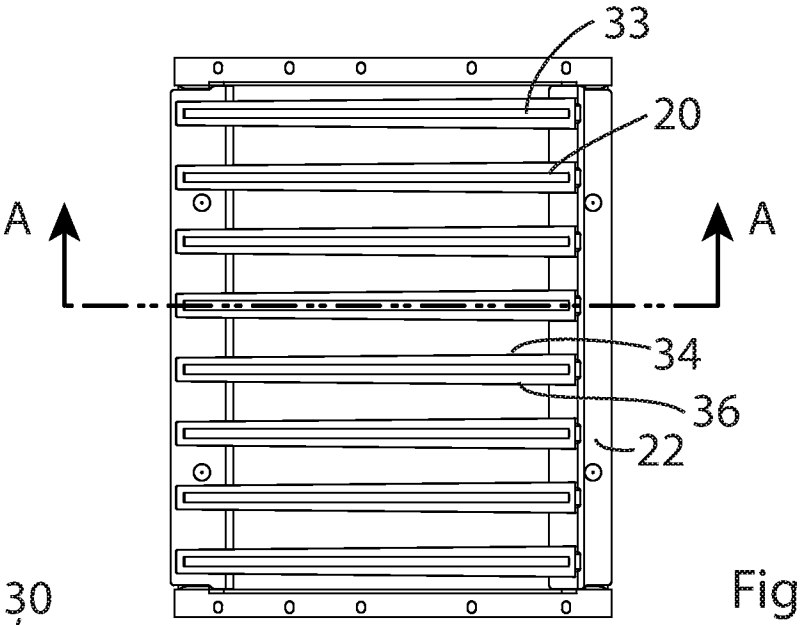
FIG. 2 is a plan view of a screening bar assembly of the screen of FIG. 1.

FIG. 1 shows a grizzly screen incorporating a plurality of screening bar assemblies in accordance with an embodiment of the present invention.

The screen comprises a pair of substantially parallel side walls 2,4 interconnected by transversely extending bridging members (hidden in FIG. 1) to define a main frame of the screen. Mounted on this frame are four screening bar assemblies 6,8,10,12, each comprising a set of substantially parallel screening bars (or bofor bars) 20 defining a downwardly sloping deck over which feed material to be screened may be passed.

The screening bars 20, which may typically be formed from metal, in each assembly are mounted to a respective support frame 22 arranged such that the bars 20 are mounted in longitudinal alignment with the slope of the deck and the path of the material thereon. In the embodiment shown in the drawings, four screening bar assemblies 6,8,10,12 are provided along the length of the main frame of the screen, arranged inline. More or less sets of screening bars may be utilised depending upon the size of the screen. The bars 20 are arranged to define a stepped screening deck over which the feed material passes, undersize material falling through the gaps between the bars to be received in a collection hopper/chute therebelow while larger rocks and boulders pass over the deck to pass over a downstream end of the deck to be delivered onto a conveyor. The undersize material may pass over a downstream end of the collection hopper/chute beneath the deck to be delivered onto a second conveyor.

The main frame may be mounted on a base or chassis of the screen via resilient linkages, such as springs 14, and the frame, and thus the deck may be vibrated by means of a pair of counter rotating rotors defining eccentric masses, driven by one or more drive motors, to impart circular or reciprocating vibratory motion to the deck. Accordingly the deck may be vibrated to agitate the material on the deck of the screen and to encourage undersize material to pass between the sets of bars while conveying the material across the deck such that the oversize material is discharged over a downstream end of the deck onto a conveyor. Alternatively the sets of screening bars may be mounted on a stationary chassis or base, gravity being relied on to convey the material over the deck defined by the bars.

In each screening bar assembly 6,8,10,12, each bar 20 is coupled to its support frame 22 via compliant mounting blocks 24,26 formed from a different material than the bars, preferably formed from a polymer material although other metallic and non-metallic compliant material are envisaged, and provided at each end of each bar 20 such that there are no welds or bolted connections between the bars 20 and the support frame 22 within which they are mounted, nor any direct metal to metal contact between the relatively rigid metal bars 20 and the relatively rigid metal support frame 22. The bars 20 are primarily held in place by a friction or interference fit between the compliant mounting blocks 24,26 and the support frame 22. As well as providing a secure coupling between the bars 20 and the support frame 22, the compliant mounting blocks 24,26 absorb shocks during use which protects the support frame 22 and any component to which it is attached from damage that might otherwise be caused by rocks impacting on the bars 20.

Figure 3:
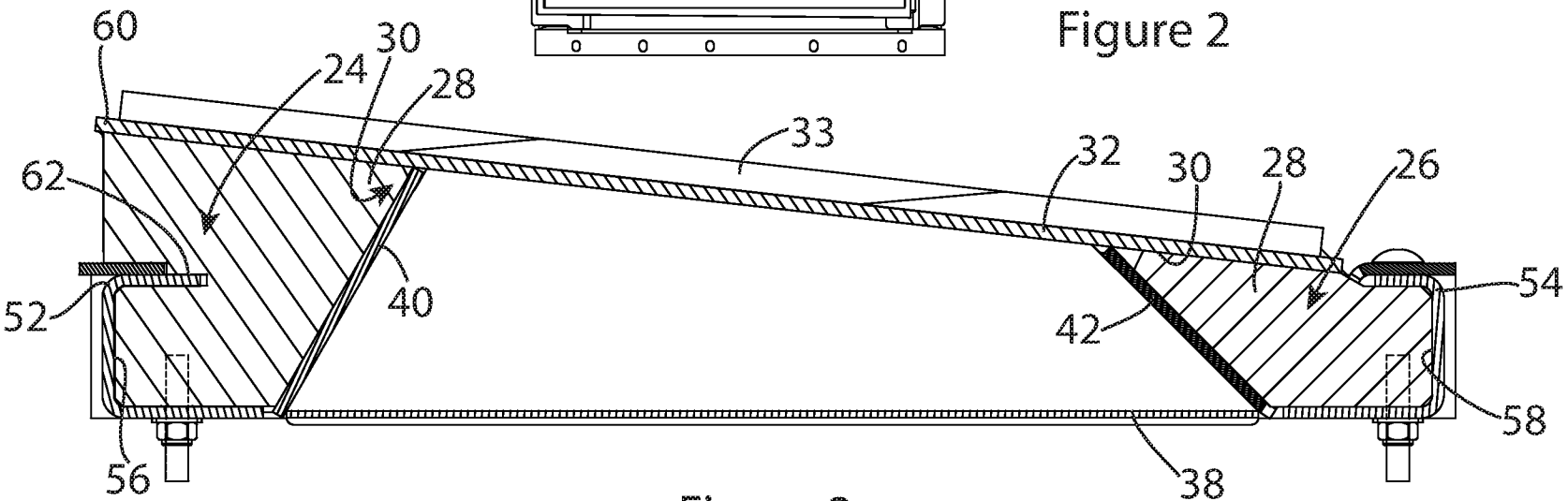
FIG. 3 is a sectional view through one bar of the assembly on line A-A of FIG. 2.
Figure 4:
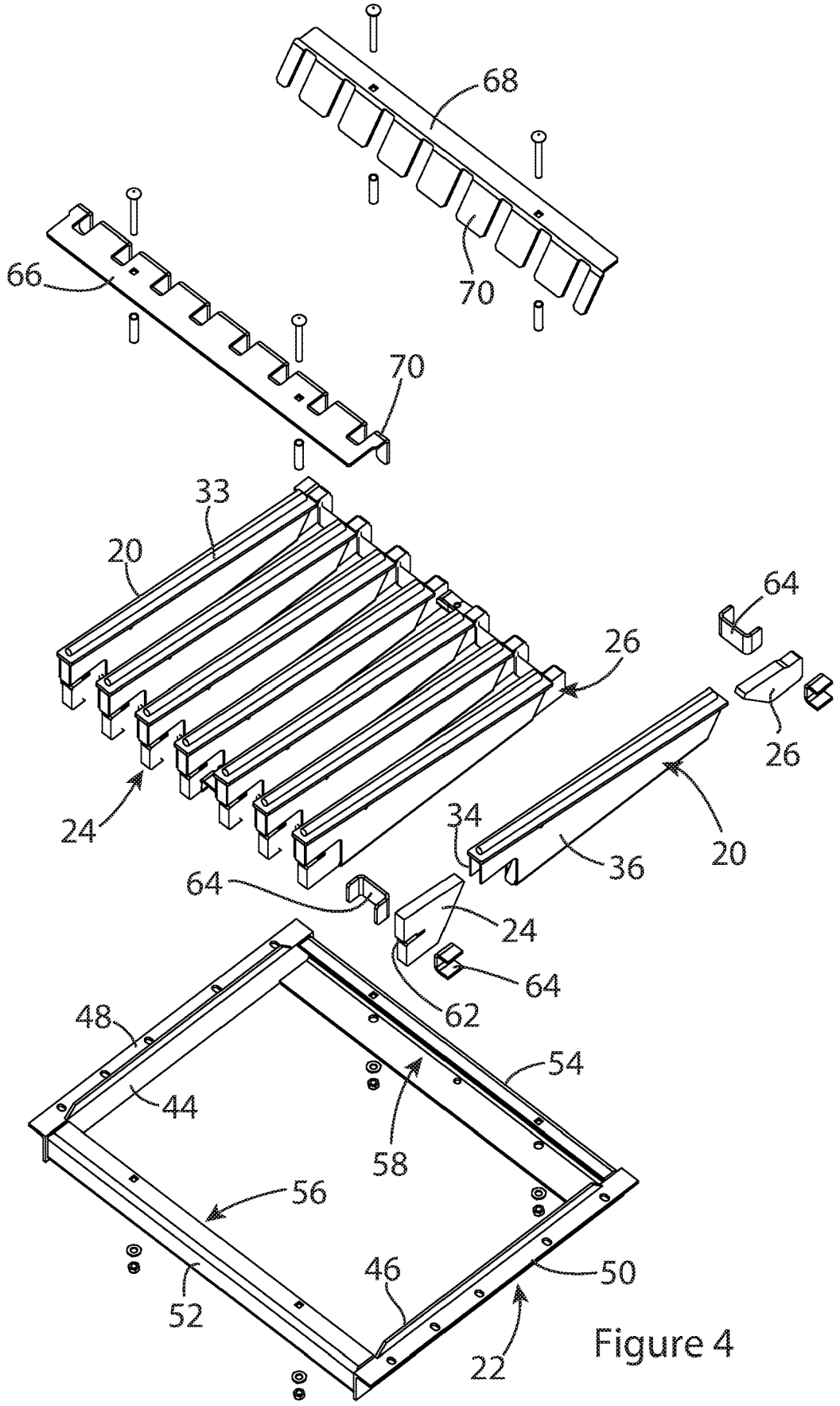
FIG. 4 is an exploded view of the screening bar assembly of FIG. 2.

As best illustrated in FIG. 3, in a preferred embodiment there is a wedge shaped engagement between the mounting blocks 24,26 and the bars 20. Each mounting block 24,26 comprises a wedge shaped end 28 adapted to be received in a corresponding wedge shaped recess 30 in a respective end of each bar 20. This forces the mounting blocks 24,26 and the bars 20 together under load which helps prevent movement between the mounting blocks 24,26 and the bars 20.

Each bar 20 may comprise an upper wall 32, a pair of depending side walls 34,36 and a bottom wall 38, end walls 40,42 extending between the bottom wall 38 and upper wall 32, between the side walls 34,36 at either end of each bar 20, said end walls 40,42 extending at an acute angle to said bottom wall 38 to abut the upper wall 32 inwardly from the outer ends of the upper wall 32 such that the ends walls 40,42, side walls 34,36 and a respective outer region of the upper wall 32 define between them said wedge shaped recesses in the respective ends of each bar 20 for receiving a cooperating portion of a respective mounting block 24,26 therein. The outer ends of each side wall 34,36 of each bar 20 are shaped such that the side walls do not contact the support frame 22 when the bars 20 are mounted therein via said mounting blocks 24,26. The upper wall 32 of each screening bar 20 may be reinforced by an elongate rod 33 or similar strengthening member welded to an upper face thereof to reinforce the bar and resist wear. The rods 33 may also serve to break up material and to focus material impact forces towards the centerline of each bar, reducing undesirable edge loading.

Each support frame 22 comprises parallel side members 44,46 having laterally extending flanges 48,50 to facilitate bolting of the support frames 22 to the main frame of the screen, and a pair of end members 52,54 extending between the side members 44,46. Each end member 52,54 has a U shaped profile defining a mounting channel 56,58 having an inwardly facing open side, a portion of each mounting block 24,26 being adapted to engage the mounting channel of a respective end member 52,54 of the support frame 22 to retain the bars 20 in place in the support frame 22.

As illustrated in the drawings, each screening bar 20 may have an increasing height (distance between upper wall 32 and bottom wall 38) from one end to the other, preferably from an upstream to a down stream end when installed in the support frame 22 and mounted on the screen. This provides a stepped profile to the deck to facilitate breaking up of the feed material as it traverses the deck. An upper end 60 of each screening bar 20 at its deepest portion may extend above the mounting channel 56 of the support frame 22. A slot 62 may be formed in the outer end of the respective mounting block 24 mounted in the end of the bar 20 adjacent said upper end 60 of the bar 20 for receiving an upper side of the mounting channel 56 of the support frame 22 therein.

To maintain the screening bars 20 in position within the support frame 22, spacer members 64 are provided to be inserted into the mounting channels 56,58 between the mounting blocks 24,26 of the bars 20. Furthermore, retaining bars 66,68 are provided adapted to be bolted to upper faces of the end members 52,54 of the support frame, the retaining bars 66,68 having fingers 70 shaped to extend between the bars 20 to retain the spacer members 64 in position.

Figure 5:
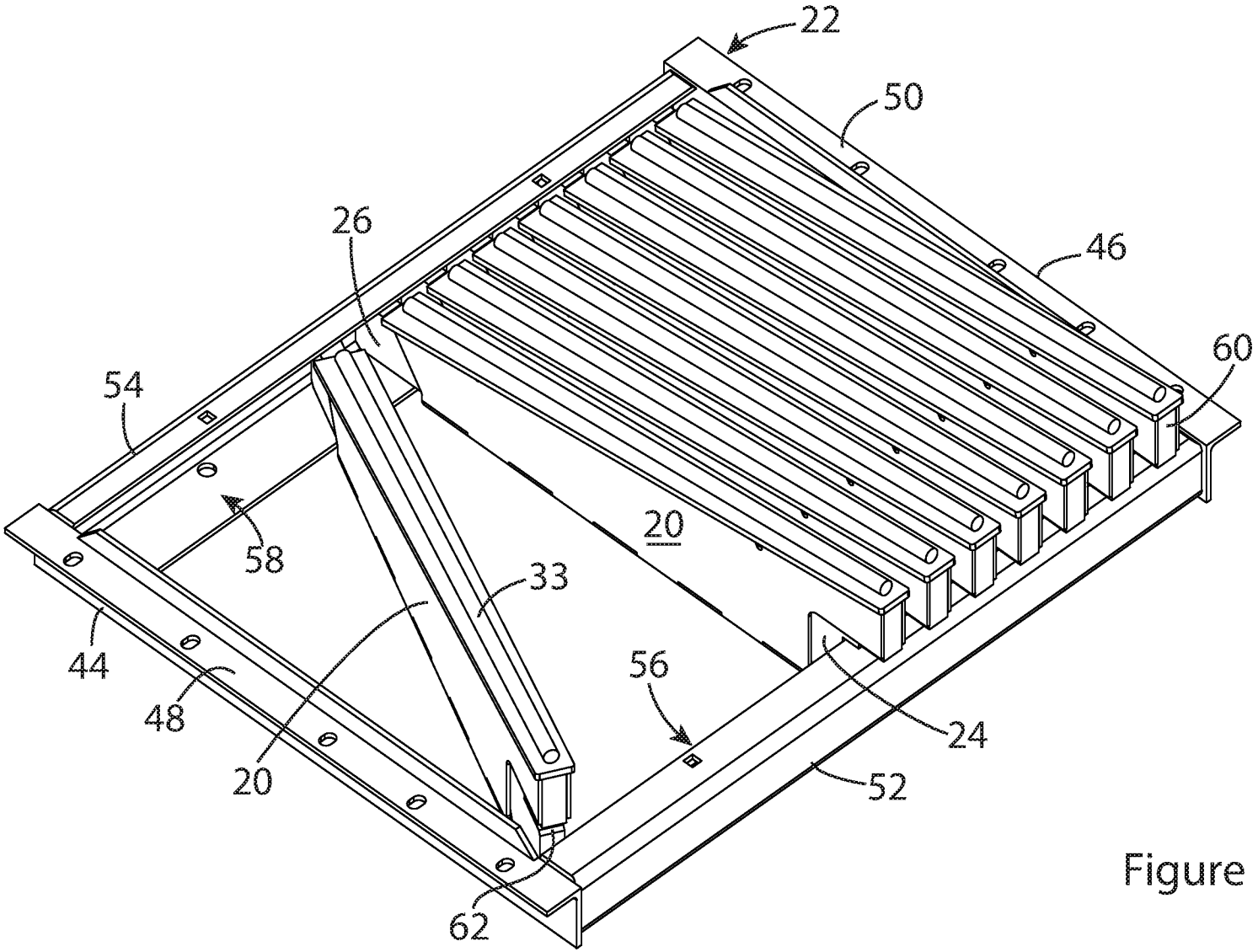
FIG. 5 is a perspective view showing the insertion of the bars into the support frame of the screening bar assembly of FIG. 2.

In use, respective mounting blocks 24,26 are inserted into each end of a respective screening bar 20 and the bar is located in its support frame 22 diagonally to allow the ends of the mounting blocks 24,26 to be received in the mounting channels 56,58 of the support frame 22, the bars subsequently being moved into an operative position parallel to the side members 44,46 of the support frame 22, as illustrated in FIG. 5, causing the mounting blocks 24,26 to engage the mounting channels 56,58 of the support frame 22.

Subsequently the spacer members 64 are located between the mounting blocks 24,26 and the retaining plates 66,68 are bolted in place to retain the bars 20 in position within the respective support frame 22.

The compliant mounting blocks 24, 26 may be formed from any suitably compliant, or resilient, material so that the blocks 24, 26 act as a compliant or resilient coupling, preferably a friction fit coupling, between the bars 20 and the support frame 22, and in particular to act as a shock absorber. The compliant mounting blocks 24,26 may be made from any suitable polymer material, such as polyethylene, polyurethane or natural rubber, although polyethylene may be preferred. Alternatively, the mounting blocks 24, 26 may be formed from a metallic or fibrous or composite material.

The invention is not limited to the embodiment described herein but can be amended or modified without departing from the scope of the present invention as defined by the appended claims.

The invention claimed is:

1. A screening bar assembly for a screen, the assembly comprising a plurality of substantially parallel screening bars mounted between end members of a substantially rectangular support frame, wherein each screening bar is coupled to the support frame by at least one respective compliant mounting block, wherein said at least one mounting block is located between, and engages with, the respective end member and a surface of the respective screening bar that faces the respective end member to provide a compliant coupling between the respective screening bar and the respective end member.

2. An assembly as claimed in claim 1, wherein the mounting blocks are formed from a polymeric material.

3. An assembly as claimed 1, wherein the mounting blocks are formed from a metallic spring material.

4. An assembly as claimed in claim 1, wherein the mounting blocks are formed from a fibrous or composite material.

5. An assembly as claimed in claim 1, wherein said support frame includes a pair of opposing mounting channels, said mounting blocks engaging said mounting channels to couple the screening bars to the support frame.

6. An assembly as claimed in claim 5, wherein said support frame comprises a pair of substantially parallel side members, said end members extending between and substantially perpendicular to the side members, said end members of the support frame incorporating said mounting channels.

7. An assembly as claimed in claim 6, wherein the screening bars, when mounted on the support frame, extend parallel to the side members of the support frame.

8. A screening bar assembly as claimed in claim 6, wherein each side member of the support frame and/or each end member includes a laterally extending mounting flange to facilitate mounting of the support frame to the screen.

9. An assembly as claimed in claim 1, wherein each end of each screening bar incorporates a mounting recess within which a portion of a respective mounting block is received.

10. An assembly as claimed in claim 9, wherein the sides of each mounting recess diverge outwardly from one another to define a wedge shaped recess receiving a correspondingly shaped portion of the respective mounting block.

11. An assembly as claimed in claim 1, wherein the vertical depth of each screening bar increases from one end to the other.

12. An assembly as claimed in claim 11, wherein an end of each screening bar at its deepest portion extends above the support frame.

13. An assembly as claimed in claim 11, wherein the vertical depth of each screening bar increases from an upstream to a downstream end when installed in the support frame and mounted on the screen, in use.

14. An assembly as claimed in claim 1, wherein spacer members are inserted between the mounting blocks of adjacent bars to maintain the position of the bars in the support frame.

15. An assembly as claimed in claim 14, wherein said support frame includes a pair of opposing mounting channels arranged, said mounting blocks engaging said mounting channels to couple the screening bars to the support frame, and wherein said spacer members are located within said mounting channels.

16. An assembly as claimed in claim 14, wherein retaining members are releasably attached to the support frame, the retaining members having fingers shaped to extend between the ends of adjacent bars to retain the spacer members in position.

17. As assembly as claimed in claim 1, wherein each end of each screening bar is coupled to the support frame by a respective compliant mounting block.

18. An assembly as claimed in claim 1, wherein said at least one mounting block provides said compliant coupling without welds or bolted connections between said at least one mounting block and the respective screening bar.

19. A screen comprising a frame defined by a pair of substantially parallel side walls interconnected by transversely extending bridging members, at least one screening bar assembly being mounted on the frame, wherein said at least one screening bar assembly comprises a plurality of substantially parallel screening bars mounted between end members of a substantially rectangular support frame, wherein each end of each screening bar is coupled to the support frame by a respective compliant mounting block provided at each end of each screening bar and engaging with a respective one of the end members.

20. A screen as claimed in claim 19, wherein the screening bars define a sloping deck, the bars of each screening bar assembly being aligned with the slope of the deck and the path of the material thereon.

21. A screen as claimed in claim 20, including means for imparting circular or reciprocating vibratory motion to the deck.

* * * * *